United States Patent [19]

Schulz et al.

[11] Patent Number: 4,836,405

[45] Date of Patent: Jun. 6, 1989

[54] CONTAINER FOR THE RECEPTION OF A PUMPABLE PRODUCT

[75] Inventors: Paul Schulz, Wuppertal; Guenther Amberg, Neuss, both of Fed. Rep. of Germany

[73] Assignee: Henkel Kommanditgesellschaft auf Aktien, Duesseldorf, Fed. Rep. of Germany

[21] Appl. No.: 149,467

[22] Filed: Jan. 28, 1988

[30] Foreign Application Priority Data

Jan. 28, 1987 [DE] Fed. Rep. of Germany ..... 3702431

[51] Int. Cl.[4] ..... B65D 25/10

[52] U.S. Cl. ..... 220/93; 222/276; 222/326

[58] Field of Search ..... 220/93, 266, 276; 222/326, 327, 541

[56] References Cited

U.S. PATENT DOCUMENTS

| | | | |
|---|---|---|---|
| 1,699,873 | 1/1929 | Brodsky | 220/93 X |
| 2,022,706 | 12/1935 | Clark | 220/93 X |
| 2,113,333 | 4/1938 | Piquerez | 222/326 |
| 2,252,115 | 8/1941 | Brue | 220/93 X |
| 2,301,933 | 3/1940 | Eberhart | 221/47.5 |
| 3,784,051 | 1/1974 | Shaw et al. | 220/93 |
| 4,209,105 | 6/1980 | Dominique | 220/93 |
| 4,299,329 | 11/1981 | Keiji | 220/276 |
| 4,331,267 | 5/1982 | Duncan et al. | 222/153 |

FOREIGN PATENT DOCUMENTS

| | | |
|---|---|---|
| 1516386 | 7/1978 | United Kingdom . |
| 1538442 | 1/1979 | United Kingdom . |

*Primary Examiner*—Steven M. Pollard

*Attorney, Agent, or Firm*—Ernest G. Szoke; Wayne C. Jaeschke; Real J. Grandmaison

[57] ABSTRACT

A container for the reception of a pumpable product can be emptied cleanly and completely without air contact by a barrel pump and associated follower plate without opening of the container lid when a section of the lid is connected as its circumferential edge by a first frangible line portion, a closure ring placed on the container wall, and a second closed frangible line portion matched to the diameter of a shaft of a barrel pump is provided in the center of the lid. The inner lid portion, bounded by the first frangible line and the second frangible line then forms an accurately fitting follower plate for a barrel pump.

3 Claims, 1 Drawing Sheet

CONTAINER FOR THE RECEPTION OF A PUMPABLE PRODUCT

BACKGROUND OF THE INVENTION

1. Field of the Invention

This invention relates to a container for the reception of a pumpable product wherein the container has a prism-shaped or cylindrical wall end portions constructed respectively as a base portion and a lid portion, the lid portion having a lid section parallel to the base section and encircling closure ring placeable on the upper edge of the container wall.

A container of the afore-mentioned type can have a barrel shape and receive viscous to pasty substances such as individual washing agents used in large amounts. For transport and storage, such a container is sealed by a lid which can consist of a lid portion and an encircling closure ring engaging over the rim of the wall of the container.

To empty such containers, a barrel pump with a follower plate is used. For the installation of the barrel pump, the lid must first be removed from the container. In so doing, the contents of the container come into contact with air, and when the container is still full can easily spill out of the container during the installation of the follower plate. A further drawback is that a properly fitting follower plate is needed for each container size. In addition, pollution by product dripping from the follower plate or from the container lid can occur during contents transfer and removal of the follower plate. Impurities such as water can enter the container when removing the container lid.

2. Description of the Invention

Other than in the operating examples, or where otherwise indicated, all numbers expressing quantities of ingredients or reaction conditions used herein are to be understood as modified in all instances by the term "about".

An object of this invention is to provide an improved container and barrel pump system so that the installation of barrel pump can be performed without air contact or danger of contaminating the product disposed in the container, eliminating the possibility of spilling the contents of the container as well as enabling the container to be completely emptied with the assistance of a barrel pump, and furthermore, one and the same barrel pump can be used for several container sizes or different barrel pumps can be used for one and the same container size.

In accordance with this invention, a container having a prism-shaped or cylindrical wall and a lid therefor is provided with a lid having a lid section and an encircling closure ring to be placed on the upper edge of said wall, wherein the lid section is connected at its circumferential edge adjoining the inside of said wall by a first frangible line portion with the closure ring and has a second closed frangible line portion which is adapted to the size of the shaft of a barrel pump and to be pierced by said shaft, so that the inner part of the lid is surrounded by the first frangible line portion and forms a closely fitting follower plate for the barrel pump. Further embodiments are described in the following.

Pursuant to this invention, a product to be transferred is placed in a container, which for example is made of a synthetic material or metal, and its holding capacity is on the order of from 10 to 500 liters as determined by the requirements of the user. The lid may also be made of a synthetic material and have a closure ring which lies tightly on the upper surface of the container wall and has a first frangible line portion adjoining the inside of the container wall. A central area which corresponds to the pump shaft diameter, and typically has a circular shape, is bounded by the second frangible line portion in the center of the lid.

When a product is to be conveyed out of the container in accordance with the invention, a barrel pump, for example a hand barrel pump of simple construction, such as an eccentric worm or helix pump, is placed on the central area of the lid surrounded by the second frangible line portion and punched through the lid by a sharp blow, and introduced into the pasty product as far as the container base. Subsequently, the inner part of the lid section enclosed by the first frangible line portion is severed from the outer closure ring by also breaking the first frangible line portion by a suitable guided blow. The inner part of the lid section, which is preferably adjacent to a first sealing collar at the circumferential wall portion of the container, and adjacent to a second sealing collar at the pump shaft, now forms a closely-fitting follower plate of the barrel pump.

By the invention, it is provided that the lid need not be opened for the removal of the container contents. The container contents can therefore neither come into contact with air nor be polluted during the emptying process. Since the lid is not taken off, but merely converted into a follower plate, product cannot splash out of the container even at the start of the emptying process. A further advantage consists in that the follower plate needed for the barrel pump is already integrated in the delivered container lid. Thus, barrel pumps of very diverse modes of construction can be used when only their pump shaft diameter enters sealingly into the central lid area, bounded by the second frangible line portion of the lid section.

The lid of the container according to the invention is by its nature a disposable part. The container itself can be used several times, particularly when a container design of particularly stable construction is required for conveying media of high viscosity and for high pump throughput. The container can however also be constructed as a disposable structure.

For various applications, wherein a place of a barrel pump for conveying of the container contents a more remotely arranged, external conveying equipment is provided, the container can be provided in its base region with a suitable nipple or with an opening for connection to such an external pump installation. In such case, the severed lid likewise functions as a follower plate and a second closed frangible line portion in the lid, otherwise to be pierced by the pump shaft, can then be dispensed with.

Details of the invention are further shown by reference to the following drawings of an embodiment hereof.

BRIEF DESCRIPTION OF THE INVENTION

DETAILED DESCRIPTION OF THE DRAWINGS

Figure 1:
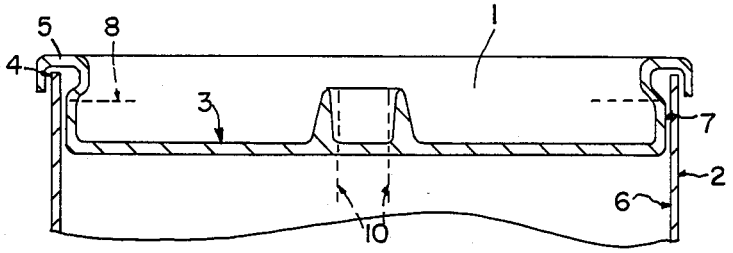
FIG. 1 is a cross-sectional view of a lid serving as a container closure provided with frangible line portions.
Figure 2:
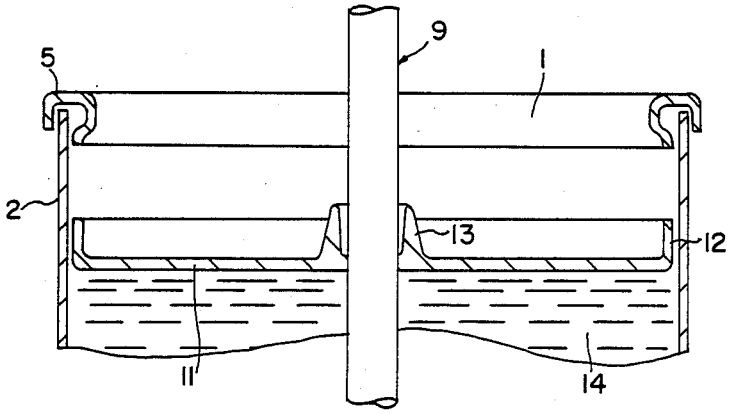
FIG. 2 is a cross-sectional view of FIG. 1 including a barrel pump shaft inserted in a lid, and sealing collars.

A container, as partially shown in FIG. 1 and FIG. 2, is closed by a lid generally designated as lid 1. The container may have the shape of a straight or inclined prism with any desired, but parallel end areas representing a lid and a base portion. Preferably, the prism-shaped wall 2 of the container has a cylidrical shape. In such event, the lid 1 which has a lid section 3 and an encircling closure ring 5 to be placed on the upper edge 4 of the wall 2, is of circular shape.

The lid section 3 as shown in FIG. 1 is connected at its circumferential edge 7 adjacent to the inside 6 of the wall 2 by way of a first frangible line portion 8 with the closure ring 5. In addition, the lid section 3 is provided with a second closed frangible line portion 10, which is sized equivalent to the diameter of a shaft 9 (FIG. 2) of a barrel pump and to be pierced by the shaft 9, in such manner that the lid section delineated by the first frangible line portion 8 of the lid 1 can serve as an accurately fitting follower plate 11 of the barrel pump.

As shown in FIG. 2, the lid 1 preferably has a closely fitting first sealing collar 12 standing generally parallel to the inside surface 6 of the circumferential wall 2, between the closure ring 5 and the first frangible line portion 8. A second closely fitting sealing collar 13 is provided at the internal circumference thereof, adjoining the second frangible line portion 10 of the lid section 3. Through both the sealing collars 12 and 13, the container may be emptied by the pump shaft 9 without air contact, cleanly and completely through suction of the product 14.

Due to the fact that the lid 1 simultaneously performs the task of a secure container closure and, after detachment from the closure ring 5, the function of a movable follower plate 11, there is attained not only a greater flexibility in the use of barrel pumps, but also a simplified and assured pumping-out of the container contents.

I claim:

1. A container for the reception of a pumpable product, said container having a prism-shaped or cylindrical wall and end portions constructed respectively as a base and a lid, said lid comprising a lid section and an encircling closure ring placeable on the upper edge of said wall, wherein said lid section is connected at its circumferential edge adjoining the inside of said wall by a first frangible line portion with said closure ring and has a second closed frangible line portion located in the central area of said lid which is adapted to the size of the shaft of a barrel pump and to be pierced by said shaft, so that the inner part of said lid is surrounded by said first frangible line portion and forms a closely fitting follower plate for said barrel pump.

2. A container as in claim 1 wherein said lid between said closure ring and said first frangible line portion has a closely fitting first sealing collar standing generally parallel to the inside surface of said wall.

3. A container as in claim 2 wherein a second closely fitting sealing collar, which in use lies against said shaft of said barrel pump, is provided between said second frangible line portion and the inner part of said lid.

* * * * *